US005303429A

United States Patent [19]

Nötzold

[11] Patent Number: 5,303,429

[45] Date of Patent: Apr. 19, 1994

[54] CONNECTING ELEMENT BETWEEN WC SEAT/LID AND WC BOWL

[76] Inventor: Norbert Nötzold, Felixweg 7, 8130 Starnberg, Fed. Rep. of Germany

[21] Appl. No.: 778,932

[22] PCT Filed: May 25, 1990

[86] PCT No.: PCT/EP90/00834

§ 371 Date: Feb. 7, 1992

§ 102(e) Date: Feb. 7, 1992

[87] PCT Pub. No.: WO90/15565

PCT Pub. Date: Dec. 27, 1990

[30] Foreign Application Priority Data

Jun. 14, 1989 [DE] Fed. Rep. of Germany ..... 3919408

[51] Int. Cl.[5] ..... A47K 13/26

[52] U.S. Cl. ..... 4/237

[58] Field of Search ..... 4/234–237, 4/240

[56] References Cited

U.S. PATENT DOCUMENTS

| | | | |
|---|---|---|---|
| 2,593,534 | 4/1952 | Campanelli | 4/240 |
| 3,055,015 | 9/1962 | Silverman | 4/240 |
| 3,613,130 | 10/1971 | Sansone | 4/240 |
| 4,080,671 | 3/1978 | Stahli | 4/240 X |
| 4,309,780 | 1/1982 | Fantetti | 4/234 |
| 4,319,365 | 3/1982 | Bemis et al. | 4/236 |

FOREIGN PATENT DOCUMENTS

| | | | |
|---|---|---|---|
| 3405350 | 8/1985 | Fed. Rep. of Germany | 4/240 |
| 0248440 | 5/1947 | Switzerland | 4/240 |

*Primary Examiner*—Charles E. Phillips

*Attorney, Agent, or Firm*—Feiereisen & Kueffner

[57] ABSTRACT

A connector rotatably joining the toilet seat/cover permits rapid attachment to a toilet bowl without the use of tools and without leaving securing members on the toilet bowl, whereby the closing of clamping components in the existing, seat mounting holes in the toilet bowl and atmospheric pressure by means of suction cups holds the toilet seat/cover to the edge of the toilet bowl.

10 Claims, 4 Drawing Sheets

CONNECTING ELEMENT BETWEEN WC SEAT/LID AND WC BOWL

BACKGROUND OF THE INVENTION

The present invention refers to a connector assembly for providing a rapid attachment of a toilet seat and toilet cover to a toilet bowl without requirement of any tools.

The prior art (CH-PS 391,321; CH-PS 338,005; CH-PS 484,779, FR-PS 1,036,070; U.S. Pat. No. 2,913,735; DE-OS 2,400,663; DE-OS 3,035,499; DE-GM 1,968,479; FR-PS 1,000,024; U.S. Pat. No. 2,235,913; DE-AS 2,700,663; GB-PS 1,248,399; GB-PS 1,203,099) generally fails to disclose a toilet seat with or without cover, which can be rapidly removed (within 1.0 second) from the toilet bowl without any adapter elements, clamping devices or similar elements remaining on the bowl. The prior art generally refers to special seats requiring such adapted mounting elements with corresponding counterpart which remain attached to the toilet bowl when the seat is exchanged. Moreover, a user is expected to cope with a threading method which requires three hands (finding the hole on each side and at the same time inserting and holding the toilet seat/-cover combination); this inconvenience has so far denied all previous proposals success on the market. The mounting holes on the toilet bowl provided for attachment of the seat/cover unit are provided with adapters which may include further mechanical elements so that these areas cannot be kept free of germs and have concealed or visible deposits of urinary calculus which require the application of chemical products to eliminate odors. The optical appearance does not give an aesthetic impression.

SUMMARY OF THE INVENTION

It is an object of the present invention to provide an improved connector assembly obviating the aforestated drawbacks.

This object is attained in accordance with the present invention in that this rapid connector assembly can replace the existing holding or guiding arbors in any existing toilet seat. After removing the screw connection—usually two nuts with corresponding threaded rods—the toilet seat and cover are separated. In order to eliminate the problems involved in threading unwieldy parts into position, the present invention proposes to push a fixed holding arbor at one side diagonally to the imaginary axis through the mounting bores in the toilet seat and cover. This fixed holding arbor projects from the mounting bore in the toilet seat far enough to allow the cover with its blind bore to be mounted on the projecting spherical stub so that it can also be swivelled. The spring-loaded holding arbor is pushed into the mounting which is thus positioned flush with the mounting bores in the toilet seat and cover. The holding arbor automatically slides into the bearing of toilet seat and cover. This process can be carried out once only as the connector assembly can, but need not, remain on the seat and cover.

The connector assembly includes a base plate from which two tie rods with corresponding clamping elements project. These two projecting elements are inserted into the mounting holes of the toilet bowl. Any differences in the distance between the mounting holes in the toilet bowl can be compensated by shifting eccentric levers which are slidably mounted in a grip element and clamping elements which are connected via engagement pins to the eccentric levers.

With the connector assembly according to the present invention, the permanently connected seat/cover unit can be inserted in the mounting holes of the toilet bowl and fixedly secured by downwardly pressing the eccentric lever to effect a volume change of the clamping elements of rubber i.e. the change from length reduction to circumferential expansion results in an excellent clamping action in the mounting holes of the toilet bowl. The insertion of the connector assembly in the mounting holes of the toilet bowl and the actuation of the eccentric levers can be carried out within 0.5 seconds. By moving the eccentric levers upwards via the grip element, the clamping rubbers return to their slim cylindrical shape, allowing the toilet seat/cover combination to be removed in even less time. It is of course possible to retrofit the toilet seat only with this rapid connector assembly.

In accordance with a second embodiment, a rapid connector assembly of same outer dimensions utilizes the permanent air pressure for attaching the connector assembly and thus the toilet seat/cover combination. The base plate of this rapid connector assembly includes a one-piece receptacle-like mounting which holds variously shaped one or two disk-shaped suctions elements of rubber or soft plastic material. These suction elements are extended outwardly through bores in the mounting by respective tension bars which are operatively connected with an eccentric lever. The mounting for the suction elements is suitably connected to the base plate via two opposing connecting webs in order to compensate for any unevenness or tolerances common in ceramic toilet bowls. By lowering the eccentric lever in a circular manner, the tension bars are drawn upwards to cause an outward arching of the suction elements to effect a volumetric increase thereof. The resulting vacuum created within the suction elements causes the outer atmospheric pressure to become active, resulting in excellent adhesion of the suction elements and the parts attached to it. The glazed surface of toilet bowls or other sanitary appliances ensures permanent adhesion.

For eliminating lateral deflective forces and ensuring permanent positioning of the connector assembly and toilet seat/cover unit, the connector assembly further includes a locking mechanism with an adjuster disk rotatably retained in a recess of the base plate and eccentrically supporting a retention pin with a locking knob. When placing the connector assembly on the toilet bowl and turning the adjuster disk, the locking knob can be accordingly aligned with the respective mounting holes so that the connector assembly can be conformed to tolerances and dimensions of different toilet bowls. The adjustment of the connector assembly to fit different types of toilet bowls can be carried out without requirement of any tools simply by engaging a coin into a respective slot in the adjuster. The selected position of the adjuster disk and thus of the locking knob can be fixed by a snap-in catch which projects from the base plate and is engageable in respective notches spaced about the circumference of the adjuster disk.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 2:
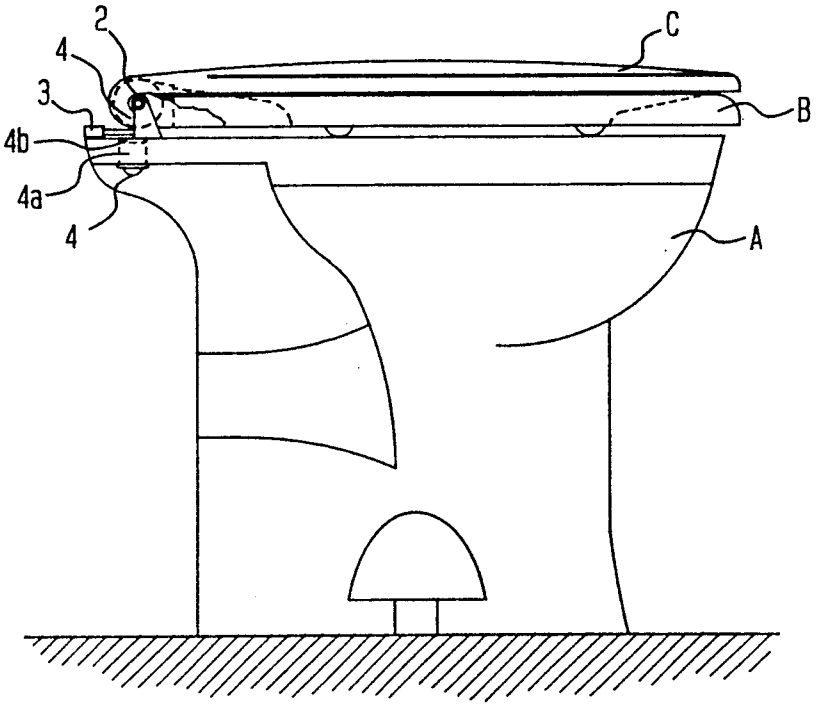
FIG. 2 is a side view of the toilet of FIG. 1.
Figure 1:
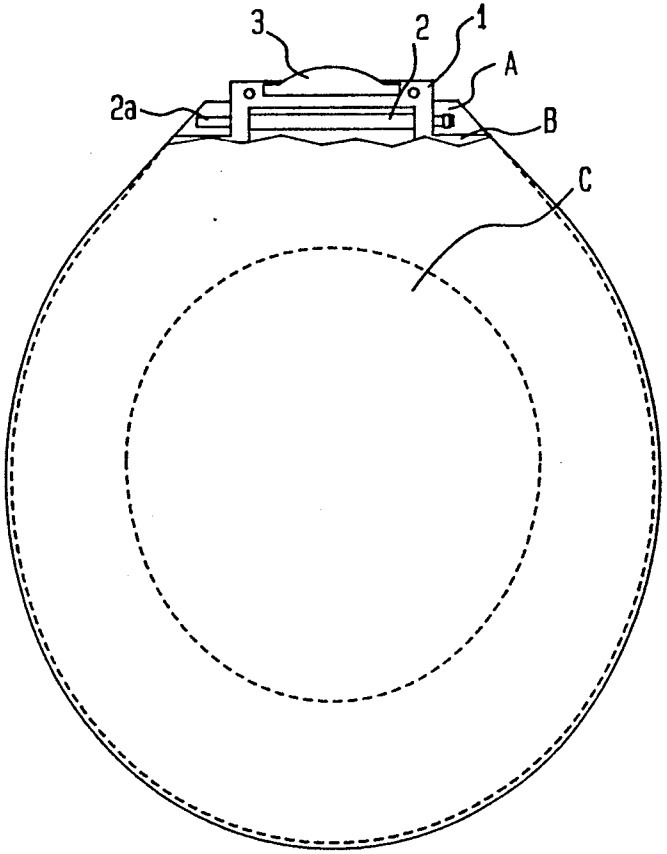
FIG. 1 is a top view upon a toilet illustrating one embodiment of a connector assembly for coupling a toilet seat to a toilet bowl.
Figure 3:
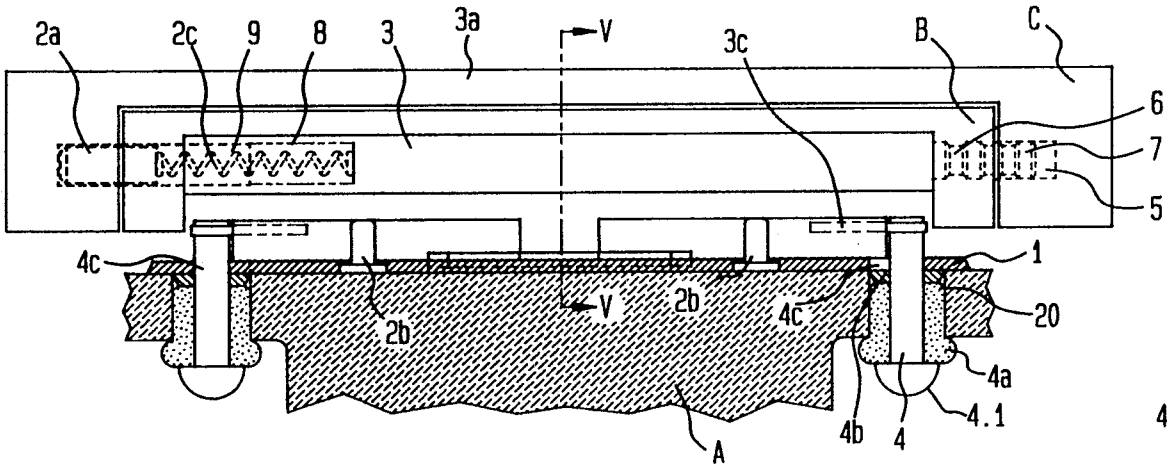
FIG. 3 is a frontal sectional view of the connector assembly of FIG. 1.

Referring now to the drawing and in particular to FIGS. 1 and 2, there is shown a toilet with a toilet bowl A, a seat B and a cover C which is swingably mounted to the seat B by a mounting 2 and shown in more detail in FIG. 3.

As can be best seen from FIG. 3, the seat B and the cover C are both of essentially U-shaped profile with aligned mounting bores 5 at each side thereof. The mounting 2 includes a fixed holding arbor 2*e*, with one end bearing upon the inside wall surface of the seat B at one side thereof and with the other end provided with a necking 6 which projects into the aligned mounting bores 5 of seat B and cover C at the other side thereof. The necking 6 includes two spaced enlargements 7 which have a diameter corresponding to the inner diameter of the aligned mounting bores 5. The distance between the enlargements 7 is several millimeters longer than the axial length of the mounting bore 5 in the seat B while the distance between the axial end of the holding arbor 2*e* and the first enlargement 7 is about half the length of the mounting bore 5 of the seat B.

At its other end, the fixed holding arbor 2*e* is provided with a blind bore 8 which receives one end of a further holding arbor 2*a* traversing the aligned mounting bores 5 at the other side of seat B and cover C and provided with a blind bore 9 for receiving one end of a compression spring 2*c*. The other end of the compression spring 2*c* is supported in the blind bore 8 of the holding arbor 2*e*. In this manner, the holding arbor 2*a* is slidingly mounted relative to the fixed holding arbor 2*e* so as to avoid any axial clearance to the mounting bores 5 in the seat B and cover C.

Figure 4:
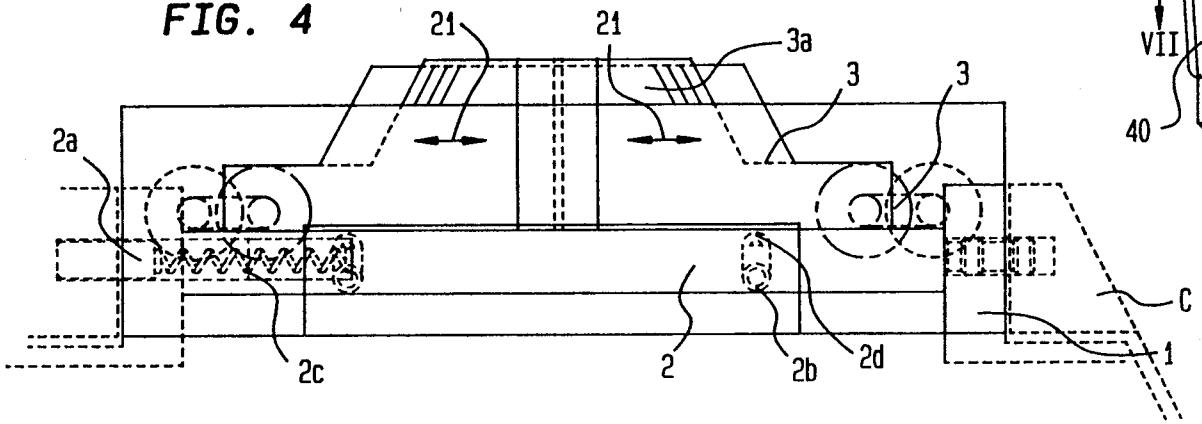
FIG. 4 is a top plan view of the connector assembly of FIG. 1.

The mounting 2 by which the seat B and the cover C are swingably connected with each other are secured to a base plate 1 which is part of the connector assembly in accordance with the present invention and shown in detail in FIG. 3. The base plate 1 may be a one-piece element or of split design to best suit the surface configuration of the bowl A and is provided with two spaced screw holes 2*d* which are engaged by respective screws 2*b* for attaching the mounting 2 to the base plate 1. As best seen in FIG. 4, the screw holes 2*d* are of oblong configuration so as to allow variable positioning of the mounting 2 and to allow the seat B to be adjusted in forward, backward and diagonal direction.

The base plate 1 is further provided at each side thereof with an oblong bore 4*c* which is traversed by a connecting or tie rod 4. Each tie rod 4 projects beyond the base plate 1 and is fixedly secured to an eccentric lever 3 by means of one engagement pin 3*c*. Both eccentric levers 3 are slidably retained in a grip element 3*a* to allow simultaneous actuation of the levers 3 and lateral movement of the eccentric levers 3 in direction of double arrows 21 as shown in FIG. 4.

As best seen in FIG. 3, the shank of each tie rod 4 is surrounded by a sleeve-like or cylindrical elastic clamping element 4*a* which is made of rubber or soft plastic material and extends between the head 4.1 of the tie rod 4 and a disk (shaped washer) 4*b* arranged at the underside of the base plate 1 and traversed by the pertaining tie rod 4. Suitably, the disk 4*b* may be connected with a nut to adjust the position of the disk 4*b* along the tie rod 4. Alternatively, the head 4.1 may be a nut which is shiftable along the outer thread of the tie rod to allow adjustment of the clamping element 4*a*, and—if removed—to allow substitution of one clamping element 4*a* with another clamping element 4*a*.

When mounting the seat/cover unit B, C to the bowl A, the tie rods 4 together with the attached clamping elements 4*a* are inserted in the mounting holes 20, with the clamping elements 4*a* loosely filling out the mounting holes 20. Possible misalignments between the tie rods 4 and the mounting holes 20 can be compensated by shifting the levers 3 in grip element 3*a* in direction of arrows 21 to thereby reposition the tie rods 4 in the oblong bores 4*c* of the base plate 1, as indicated in FIG. 4, and to align them with the mounting holes 20. Thus, varying distances between the mounting holes 20 in different toilet bowls can easily be compensated.

Figure 5:
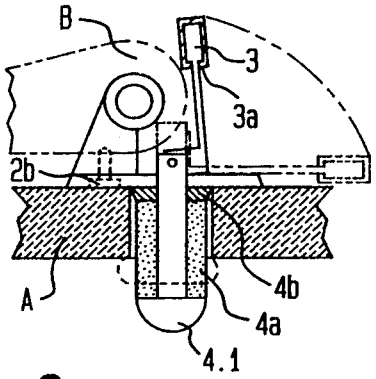
FIG. 5 is a sectional view of the connector assembly, taken along the line V—V in FIG. 3 and illustrating in detail the provision of a deformable clamping element.

Subsequently, the grip element 3*a* is pressed downwardly so that the levers 3 are moved downwardly into a position as shown in FIG. 5 in broken lines. The downward movement of the levers 3 draws the tie rods 4 upwardly, as shown in FIG. 3 which indicates a lower and upper position of the tie rods 4, so that the clamping elements 4*a* are squeezed together to increase in width and to jam within the mounting holes 20 for tightly securing the seat/cover unit B, C to the bowl A. The disks 4*b* bear against the base plate 1 to prevent the clamping elements 4*a* from being pushed through the bores 4*c*. When replacing the seat/cover unit, the grip element 3*a* is simply pulled upwards to its position as shown in FIG. 5 in continuous lines to thereby relax the pressure upon the clamping elements 4*a* which thus return to their original configuration to allow withdrawal or detachment of the seat/cover unit from the mounting holes 20.

Attachment or detachment of the seat/cover unit B, C to and from the toilet bowl A can be attained within 0.5 seconds. Persons skilled in the art will understand that it is certainly possible to fit only the seat B with a connector assembly according to the invention.

Figure 6:
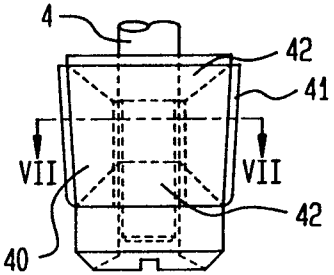
FIG. 6 is a sectional illustration of a variation of the clamping element.
Figure 7:
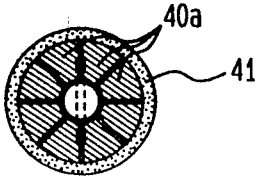
FIG. 7 is a sectional illustration of the clamping element of FIG. 6, taken along the line VII—VII in FIG. 6.

Turning now to FIGS. 6 and 7, there are shown a modification of the connector assembly, with the difference to the embodiment of FIG. 3 residing in the design of the disk and clamping element. As shown in FIGS. 6 and 7, each tie rod 4 is surrounded by an elastic clamping element 40 suitably of rubber or soft plastic material that is composed of individual sector-like segments 40*a* which are enclosed by an outer elastic sleeve 41 made of elastomer or spring steel. The clamping element 40 extends between two inwardly tapered disks 42. When attaching the seat/cover unit to the bowl A in a manner as set forth above and downwardly pushing the levers 3 by grip element 3*a*, the upward movement of the tie rods 4 axially compresses the clamping element 40 between the disks 42 so that the segments 40*a* expand or spread in radial direction to jam the clamping elements 40 in the respective mounting holes 20.

Figure 8:
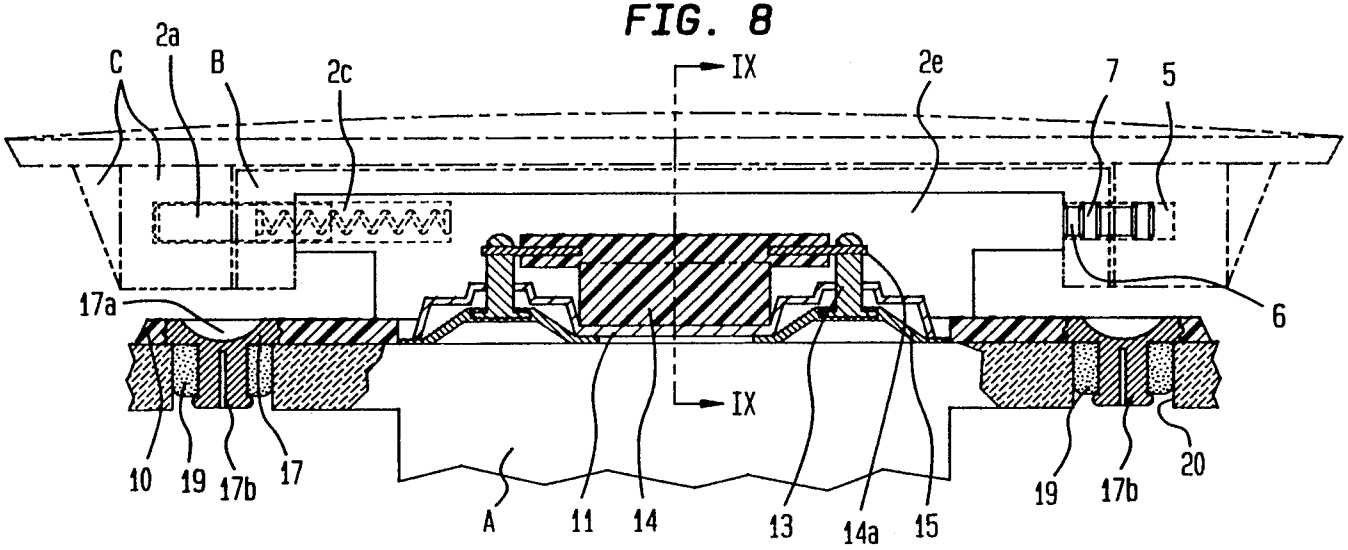
FIG. 8 is a frontal sectional view of a second embodiment of a connector assembly for coupling a toilet seat to the toilet bowl, taken along the line VIII—VIII in FIG. 10.
Figure 10:
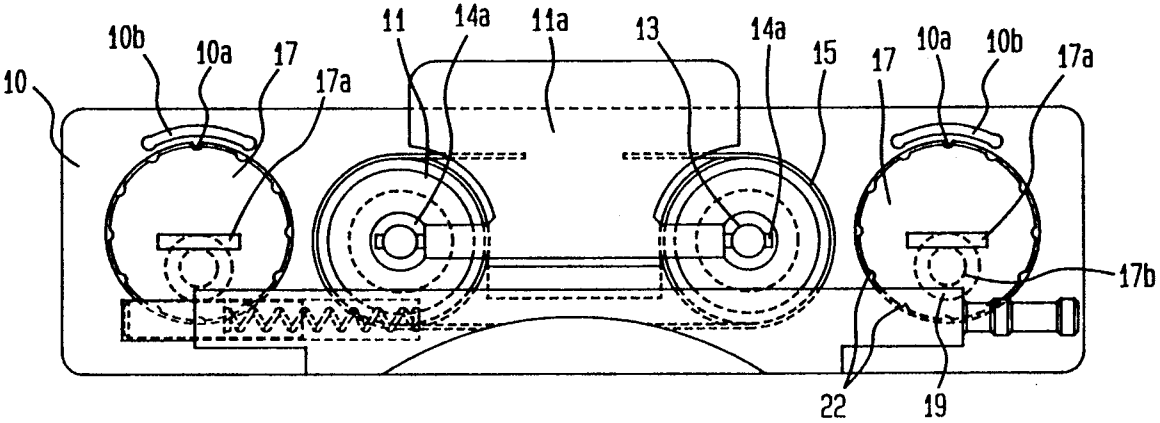
FIG. 10 is a top plan view of the connector assembly of FIG. 8.
Figure 9:
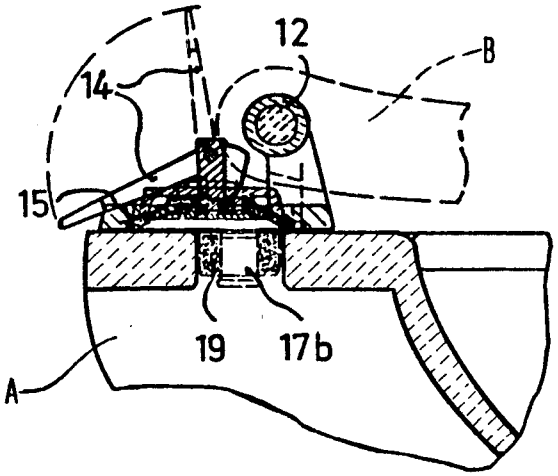
FIG. 9 is a sectional view of the connector assembly, taken along the line IX—IX in FIG. 8.

Turning now to FIGS. 8–10, there is shown a second embodiment of a connector assembly for detachably securing a seat/cover unit B, C, to a toilet bowl A, with the difference to the first embodiment residing in the utilization of permanent air pressure for attaching the connector assembly and thus the WC seat/cover unit to the bowl A.

The attachment of the mounting 2 to the seat B and the cover C corresponds to the one described in connection with the embodiment of FIG. 1 so that a further description thereof is omitted for sake of simplicity.

The second embodiment of a connector assembly according to the invention includes a base plate 10 which supports a receptacle-like mounting 11 with at least one recess (two recesses are shown in FIG. 8) for holding a disk-shaped suction cup 15 of rubber or soft plastic material. The connection of the mounting 11 with the base plate 10 is attained via opposing connecting webs 11*a* which allow a correct alignment of the seat/cover unit B, C with the bowl A and thus compensation of any unevenness or tolerances occurring in ceramic toilet bowls. Each suction cup 15 is provided at the center of its bowl-distant side with a vertical tension bar 13 which extends through a suitable bore of the mounting 11 toward the outside. At its end distant to the suction cup 15, each tension bar 15 is provided with a cross bore in which one end of an engagement pin 14*a* is retained. The other end of both engagement pins 14*a* is coupled to an eccentric lever 14.

Laterally spaced at each side from the mounting 11 is a further recess in which an adjuster in form of a disk 17 is rotatably supported. Eccentrically mounted to the adjuster 17 is a downwardly projecting retention pin 17*b* which carries a sleeve-shaped locking knob 19 of plastic material. At a central location thereof, the adjuster 17 is provided with a rectangular slot 17*a* for engagement by a coin in order to facilitate rotation of the adjuster 17 and to indicate the position of the locking knobs 19. In vicinity of the circumference of the adjuster 17, the base plate 10 is provided with a snap-in catch 10*a* which is engageable in circumferential notches 22 of the adjuster 17 to lock the selected position of the adjuster 17. A required resiliency of the snap-in catch 10*a* is provided by slot 10*b* which thus allows the snap-in catch 10*a* to be withdrawn from a selected locking position.

When attaching a seat/cover unit B, C to a toilet bowl A, the adjuster 17 is turned (by means of a coin engaged in slot 17*a*) until the retention pin 17*b* with locking knob 19 is aligned with the respective mounting hole 20 in the bowl A. Thus, it is possible to adjust the distance between both retention pins 17*b* and locking knobs 19 and thus to adapt the connector assembly to fit any type of toilet bowl.

After inserting the retention pins 17*b* and locking knobs 19 in the corresponding mounting holes 20 of the bowl A, the connector assembly is loosely retained in the bowl A so that horizontal or lateral forces are prevented from displacing the connector assembly in this direction.

In order to fixedly secure the connector assembly to the toilet bowl A, the eccentric lever 14 is now lowered in a circular manner from an upper position shown in FIG. 9 in broken lines into a lower position shown in continuous lines in FIG. 9 so that the tension bars 13 are upwardly drawn and the suction cups 15 are outwardly arched. The resulting volumetric increase of the suction cups 15 creates an underpressure within the suction cups 15 to thereby cause an adhesion thereof to the surface of the bowl A, and thus of the base plate 10 to the bowl A. The glazed surface of toilet bowls or other sanitary appliances ensures a permanent attachment, with the connector assembly being secured against displacement in axial direction by the suction cups 15 and in horizontal or lateral direction by the locking knobs 19.

I claim:

1. A toilet seat including a connector assembly for detachably securing said toilet seat to a toilet bowl; comprising:

a base, plate fixedly securable to the seat and having a pair of first recesses and a pair of second recesses;

clamping means, received in each of said first recesses for engagement in a pair of aligned mounting holes of the bowl;

suction means received in each of said second recesses for detachably securing each said base plate to said bowl, said suction means including a suction element bearing upon said toilet bowl; and actuating means operatively connected to each said suction element for creating within each said suction element an underpressure by which said base plate securely adheres to said toilet bowl.

2. A connector assembly as defined in claim 1 wherein said clamping means includes an adjuster rotatably supported in said first recesses of each of said base plate and supporting a retention pin with a locking knob for loose engagement in each mounting hole of the bowl.

3. A connector assembly as defined in claim 2 wherein said retention pin is eccentrically mounted to said adjuster so that a rotation of said adjuster allows a positioning of said retention pin in alignment with a mounting hole of the bowl.

4. A connector assembly as defined in claim 2 wherein said adjuster is disk-shaped.

5. A connector assembly as defined in claim 2 wherein said locking knob is of elastomer material.

6. A connector assembly as defined in claim 2 wherein said base plate is provided with a stop member for locking a selected position of said adjuster.

7. A connector assembly as defined in claim 1 wherein each said suction means includes a tension bar connected to said suction element at its bowl-distant side and coupled to said actuating means so that said tension bar is upwardly drawn upon actuation of said actuating means to generate the underpressure within said suction element.

8. A connector assembly as defined in claim 7 wherein said actuating means includes an engagement pin having one end engaged in an upper transverse bore of said tension bar and an eccentric lever secured to the other end of said engagement pin.

9. A connector assembly as defined in claim 1 wherein said suction element is a suction cup made of elastomer material.

10. A connector assembly as defined in claim 1, and further comprising a mounting secured to the seat, said base plate being provided with two screw holes of oblong configuration for adjustable attachment of said mounting to said base plate.

* * * * *